United States Patent [19]

Kawasaki et al.

[11] Patent Number: 4,820,687

[45] **Date of Patent: * Apr. 11, 1989**

[54] IMAGE RECEIVING SHEET AND PROCESS FOR PRODUCING THE SAME

[75] Inventors: Sadanobu Kawasaki, Tokorozawa; Mineo Yamauchi, Ichikawa; Masanori Akada, Tokyo, all of Japan

[73] Assignee: Dai Nippon Insatsu Kabushiki Kaisha, Tokyo, Japan

[ * ] Notice: The portion of the term of this patent subsequent to Dec. 2, 2003 has been disclaimed.

[21] Appl. No.: 871,918

[22] Filed: Jun. 9, 1986

[30] Foreign Application Priority Data

Jul. 25, 1983 [JP] Japan ..... 58-135627

[51] Int. Cl.[4] ..... B41M 5/035; B41M 5/26

[52] U.S. Cl. ..... 503/227; 8/471; 428/195; 428/211; 428/212; 428/447; 428/484; 428/488.1; 428/913; 428/914

[58] Field of Search ..... 427/146; 428/195, 211, 428/484, 488.1, 488.4, 913, 914, 212, 423.1, 425.1, 447, 474.4, 479.6, 480, 481; 346/227; 8/470, 471

[56] References Cited

U.S. PATENT DOCUMENTS

| | | | |
|---|---|---|---|
| 4,256,459 | 3/1981 | Russell et al. | 8/471 |
| 4,367,071 | 1/1983 | Mizuno et al. | 8/471 |
| 4,455,147 | 6/1984 | Lewis et al. | 8/471 |
| 4,555,427 | 11/1985 | Kawasaki et al. | 428/913 |
| 4,615,938 | 10/1986 | Hotta et al. | 428/913 |

FOREIGN PATENT DOCUMENTS

| | | | |
|---|---|---|---|
| 0101095 | 6/1983 | Japan | 428/913 |
| 0212394 | 10/1985 | Japan | 346/227 |
| 1106293 | 5/1986 | Japan | 346/227 |
| 1177289 | 8/1986 | Japan | 346/227 |

*Primary Examiner*—Bruce H. Hess

*Attorney, Agent, or Firm*—Parkhurst, Oliff & Berridge

[57] ABSTRACT

An image receiving sheet for use in combination with a heat transfer sheet has a substrate, an image-receiving layer provided thereon, and optionally a layer of a mold releasing agent provided on at least a part of the image-receiving layer. This image receiving sheet exhibits good mold releasability and also provides a colored image having a high density, resolving power and continuous gradation.

12 Claims, 2 Drawing Sheets

IMAGE RECEIVING SHEET AND PROCESS FOR PRODUCING THE SAME

This is a continuation of application Ser. No. 633,252 filed July 23, 1984, now U.S. Pat. No. 4,626,256.

BACKGROUND OF THE INVENTION

This invention relates to a heat transferable sheet or a sheet to be heat transfer printed, and more particularly to a heat transferable sheet which is used in combination with a heat transfer printing sheet wherein heat printing is carried out in accordance with image information by means of thermal heads, a laser beam, or the like.

Heretofore, a heat sensitive color-producing paper has been primarily used in order to obtain an image in accordance with image information by means of thermal heads, a laser beam, or the like. In this heat sensitive color-producing paper, a colorless or pale-colored leuco dye (at room temperature) and a developer provided on a base paper are contacted by the application of heat to obtain a developed color image. Phenolic compounds, derivatives of zinc salicylate, rosins and the like are generally used as such a developer.

However, the heat sensitive color-producing paper as described above has a serious drawback in that its color disappears when the resulting developed color image is stored for a long period of time. Further, color printing is restricted to two colors, and thus it is impossible to obtain a color image having a continuous gradation.

On the other hand, a heat sensitive transfer printing sheet wherein a heat-fusing wax layer having a pigment dispersed therein is provided on a base paper has been recently used. When this heat sensitive transfer printing sheet is laminated with a paper to be heat transfer printed, and then heat printing is carried out from the back of the heat sensitive transfer printing sheet, the wax layer containing the pigment is transferred onto the heat transferable paper to obtain an image. According to this printing process, an image having durability can be obtained, and a multi-color image can be obtained by using a heat sensitive transfer printing paper containing three primary color pigments and printing it many times. However, it is impossible to obtain an image having an essentially continuous gradation as in a photograph.

In recent years, there has been a growing demand for a method and means for obtaining an image like a photograph directly from an electrical signal, and a variety of attempts have been made to meet this demand. One of such attempts provides a process wherein an image is projected onto a cathode-ray tube (CRT), and a photograph is taken with a silver salt film. However, when the silver salt film is an instant film, the running cost is high. When the silver salt film is a 35 mm film, the image cannot be instantly obtained because it is necessary to carry out a development treatment after the photographing. An impact ribbon process an an ink jet process have been proposed as further processes. In the former, the quality of the image is inferior. In the latter, it is difficult to simply obtain an image like a photograph because an image treatment is required.

In order to overcome such drawbacks, there has been proposed a process wherein a heat transfer printing sheet provided with a layer of sublimable disperse dyes having heat transferability is used in combination with a heat transferable sheet, and wherein the sublimable disperse dye is transferred onto the heat transferable sheet while it is controlled to obtain an image having a gradation as in a photograph. According to this process, an image having continuous gradation can be obtained from a television signal by a simple treatment. Moreover, the apparatus used in this process is not complicated and therefore is attracting much attention.

One example of prior art technology close to this process is a process for dry transfer calico printing polyester fibers. In this dry transfer calico printing process, dyes such as sublimable disperse dyes are dispersed or dissolved in a solution of synthetic resin to form a coating composition, which is applied onto tissue paper or the like in the form of a pattern and dried to form a heat transfer printing sheet, which is laminated with polyester fibers constituting sheets to be heat transfer printed thereby to form a laminated structure, which is then heated to cause the disperse dye to be transferred onto the polyester fibers, whereby an image is obtained.

However, even if such a heat transfer printing sheet and a polyester fiber, heat transferable sheet are laminated and then subjected to heat printing by means of thermal heads or the like, it is impossible to obtain a developed color image having a high density. While one reason for this is that the surface of the polyester fiber fabric is not sufficiently smooth, it is thought that the main reason are as follows.

In a conventional dry transfer calico printing process or a wet transfer calico printing process, the transfer of the sublimable dye onto the polyester fiber fabric is carried out with ample heating time. In contrast, heating by means of thermal heads or the like is ordinarily extremely short, whereby the dye is not sufficiently transferred onto the fiber fabric. In the dry transfer calico printing process, the transfer of the dye is accomplished by heating for about one minute at a temperature of 200° C., whereas the heating by means of thermal heads is short, i.e., of the order of several milliseconds at a temperature of 400° C.

In order to overcome these problems and obtain an image having a sufficiently high density, the formation of the image-receiving layer of a heat transferable sheet with a resin having low glass transition point and yet having a high affinity for a dye such as a polyester resin (Vylon, supplied by Toyobo, K.K., Japan) has been considered. In this case, the dye can easily permeate through the image-receiving layer even with the heating energy of a thermal head, and there is the possibility that a high-density image can be obtained.

In the case of the heat transferable sheet of this type, however, if the heat transfer sheet and the heat transferable sheet, after being mated with each other and heated, are peeled, the heat transfer layer per se adheres to the image-receiving layer of the heat transferable sheet and thus is peeled to be transferred thereonto, whereby both the sheets will never be fit for use. Presumably, the reason for this is as follows.

(i) Polyethylene terephthalate (PET) is generally used as a base film in the heat transfer sheet, but there are few binders that can bind a transfer layer fast to the base film.

(ii) In order to obtain a high image density, it is necessary to use a resin having low glass transition point and softening point for the image-receiving layer of a heat transferable heat. In general, however, such a resin softens and becomes viscous when energy is applied by a thermal head.

As a result of our further research with due consideration for the above facts, we have found that all the drawbacks mentioned previously can be eliminated by using a heat transferable sheet having a specific constitution. On the basis of this finding, we have arrived at the present invention.

SUMMARY OF THE INVENTION

The present invention aims at the solution of the problems accompanying the prior art while achieving the following objects by using a heat transfer sheet comprising a heat transfer layer containing a heat transferable dye in combination with a heat transferable sheet (image receiving sheet) having a specific constitution.

(a) To provide a heat transferable sheet which prevents adhesion by heat between the image-receiving layer thereof and the heat transfer layer of a heat transfer sheet during heat transference, whereby the heat transfer layer of the heat transfer sheet does not adhere to the image-receiving layer of the heat transferable sheet and thus is not peeled to be transferred thereonto.

(b) To obtain a colored image having a high density coupled with resolving power and also having continuous gradation like a photograph directly from an electrical signal.

In order to accomplish the foregoing objects, the present invention provides a heat transferable sheet comprising an image-receiving layer having the following properties, which sheet is used in combination with a heat transfer sheet.

More specifically, the heat transferable sheet as a first embodiment of the present invention comprises a substrate and an image-receiving layer which is provided on the substrate and receives a dye transferred from a heat transfer sheet when heated, the image-receiving layer containing a dye-permeable releasing agent.

The heat transferable sheet as a second embodiment of the present invention comprises a substrate, an image-receiving layer which is provided on the substrate and receives a dye transferred from a heat transfer sheet when heated, and a layer of a dye-permeable releasing agent provided on at least a part of the image-receiving layer.

DETAILED DESCRIPTION OF THE INVENTION

Hereinafter, the present invention will be specifically described with respect to examples of practice thereof shown in the accompanying drawings.

Figure 1:
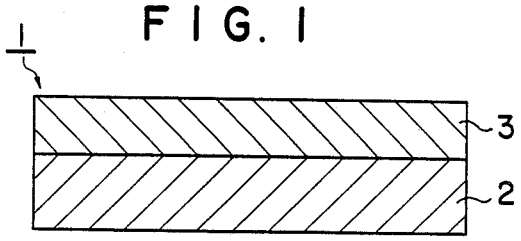
FIG. 1, FIG. 2 and FIG. 3 are cross-sectional views of the heat transferable sheet according to the present invention.

As is illustrated in FIG. 1, the heat transferable sheet 1 as a first embodiment of this invention comprises a substrate 2 and an image-receiving layer 3 provided thereon.

Figure 2:
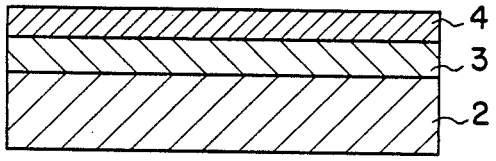
Figure 3:
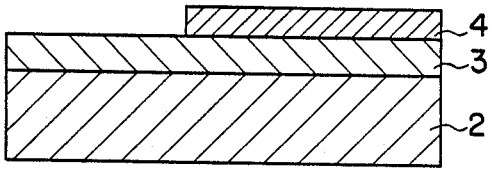

As is shown in FIG. 2, the heat transferable sheet 1 as a second embodiment of this invention comprises a substrate 2, an image-receiving layer 3 provided thereon, and a releasing agent layer 4 provided on at least a part of the dye-receiving layer 3. The releasing agent layer 4 may be provided either over the entire surface of an image-receiving layer 3 or only on a part thereof as is shown in FIG. 3.

It is desirable that the substrate 2 serve to support the image-receiving layer 3 and at the same time have such a degree of mechanical strength that the sheet can be handled without particular care even in heated state because heat is applied during heat transference.

Examples of the substrate 2 are condenser paper, glassine paper, parchment paper, or a flexible thin sheet of a paper or plastic film having a high degree of sizing. Among these, condenser paper and a polyethylene terephthalate film are used widely, the condenser paper being principally used in the case where heat resistance is important, the polyethylene terephthalate film being mainly utilized in the case where prevention of fracture during handling in a mechanical apparatus is of primary consideration. The thickness of the substrate 2 is ordinarily of the order of 3 to 50 μm, and preferably of the order of 5 to 15 μm.

The image-receiving layer 3 of the heat transferable sheet l receives a dye which is transferred from the heat transfer sheet when heated as has been set forth previously, and the following are used as such.

(a) Resins having ester linkage: Polyester resins, polyacrylate resins, poly-carbonate resins, polyvinyl acetate resins, styrene acrylate resins, and vinyltoluene acrylate (b) Resins having urethane linkage: Polyurethane resins (c) Resins having amide linkage: Polyamide resins (d) Resins having urea linkage: Urea resins (e) Resins having highly polar linkage: Polycaprolactone resins, styrene-maleic anhydride resins, polyvinyl chloride resins, and polyacrylonitrile resins.

The image-receiving layer 3 may also be formed with two types of resins having different properties. For example, the image-receiving layer may comprise a first region formed with a synthetic resin having a glass transition temperature of from −100° to 20° C. while having a polar radical, and a second region formed with a synthetic resin having a glass transition temperature of 40° C. or higher. Both the first and second regions are exposed over the surface of the image-receiving layer, the first region occupying 15% or more of the layer surface and spreading independently in the form of islands each having a length of preferably from 0.5 to 200 μm in the longitudinal direction.

In the heat transferable sheet 1 as a first embodiment of the present invention, the image-receiving layer 3 formed with the above mentioned resin(s) contains a dye-permeable releasing agent.

For the releasing agent, solid waxes, fluorine- or phosphate-containing surfactants, and silicone oils are used. These compounds are added in advance to resins which form an image-receiving layer, and a solution of the resin mixture obtained is applied onto the substrate and dried to prepare an image-receiving layer. The respective releasing agents will now be described in detail.

The solid wax is preferably dispersed in the form of fine particles in the resin which forms the image-receiving layer 3. It is therefore preferred to treat the solid wax in a ball mill or a sand mill prior to the addition thereof to the resin.

For the solid wax, polyethylene wax, amide wax and Teflon powder are used. The solid wax is added to the resin in a quantity of from 5 to 50%, preferably from 10 to 20%, of the weight of the resin. Below 5% by weight, a sufficient releasing effect cannot be obtained and the heat transfer layer adheres to the image-receiving layer upon heating in some cases. Above 50% by weight, the image-receiving layer cannot receive satisfactorily a dye transferred from the heat transfer layer upon heating and hence an image obtained does not sometimes have sufficient resolving power.

Fluorine- or phosphate-containing surfactants are also added as releasing agents to the resin which form an image-receiving layer. The releasing effect seems to be obtained because a part of the surfactant incorporated in the resin extrudes over the surface of the dye-receiving layer.

Specific examples of the surfactants are phosphate compounds such as Plysurf A208S, Plysurf A210G, and Plysurf DB-01 (supplied by Daiichi Kogyo Seiyaku K.K., Japan), and Gaffac RS-410, Gaffac RA-600, and Gaffac RE-610 (supplied by Toho Kagaku Kogyo K.K., Japan); and fluorine-containing surfactants such as Unidyne DS501 and Unidyne DS502 (Daikin Kogyo K.K., Japan), and FC430 and FC431 (supplied by Sumitomo 3M, Japan). The surfactant is added to the resin in a quantity of from 0.5 to 10% of the weight of the resin. Below 0.5% by weight, a sufficient releasing effect cannot be obtained. Above 10% by weight, the surface of the image-receiving layer becomes undesirably sticky, tends to attract dust and dirt, and, when the image-receiving layer comes into contact with a transfer layer, the dye in the transfer layer is transferred to the image-receiving layer without heating, thus resulting in scomming.

Silicone oils are also added as releasing agents to the resin which forms an image-receiving layer. While silicone oils in oil form can be utilized, those of the hardened type are preferred. Examples of hardened-type silicone oils are reaction-hardened, photohardened, and catalyst-hardened oils, the reaction-hardened silicone oils being particularly preferred.

In the case where hardened-type silicone oils are used as releasing agents, the surface of the image-receiving layer does not become sticky or attract dust and dirt as in the case of the surfactants named hereinbefore so that these silicone oils can be employed in great quantities. Thus, the hardened-type silicone oil is added to the resin in a quantity of from 0.5 to 30% of the weight of the resin. Less than 0.5% by weight of the silicone oil cannot afford a sufficient releasing effect and hence results in adhesion between the heat transfer layer and the image-receiving layer upon heating occasionally. If the silicone oil is added in excess of 30% by weight, on the other hand, the image-receiving layer cannot receive satisfactorily a dye transferred from the heat transfer layer upon heating and therefore an image obtained does not sometimes have sufficient recording density.

Preferred reaction-hardened silicone oils are those obtained by hardening through the reaction between amino-modified silicone oils and epoxy-modified silicone oils. As the amino-modified silicone oils, KF-393, KF-857, KF-858, X-22-3680, and X-22-3801C are employed while, as the epoxy-modified silicone oils, KF-100T, KF-101, X-60-164, and KF-103 are used, all being available from Shin-etsu Kagaku Kogyo K.K., Japan.

As the catalyst- or photohardened silicone oils, KS705F-PS (catalyst), KS705F-PS-1 (catalyst), KS720, KS770-PL-3 (caralyst), and KS774-PL-3 are utilized.

As has been set forth hereinbefore, the heat transferable sheet 1 as a second embodiment of the present invention comprises a substrate 2, an image-receiving layer 3 of the previously mentioned resin provided thereon, and a releasing agent layer 4 provided on at least a part of the image-receiving layer 3. The releasing agent layer 4 is formed by dissolving or dispersing the releasing agent described hereinbefore in a suitable solvent, applying the resulting solution or dispersion onto the image-receiving layer 3, and then drying the solution or dispersion.

It is desirable that the thickness of the releasing agent layer be 0.01 to 5 μm, preferably 0.05 to 2 μm. If the thickness of this layer is less than 0.01 μm, a satisfactory releasing effect cannot be obtained. Conversely, the thickness exceeding 5 μm is undesirable because the permeability of the dye is impaired.

The releasing agent layer 4 may be provided either over the entire surface of the image-receiving layer 3 or only on a part thereof as has been set forth earlier. In general, it is difficult to print explanatory notes and the like on the releasing agent layer while it is possible on the image-receiving layer. In the case where it is necessary to apply printing on the heat transferable sheet, the releasing agent layer is preferably provided only on a part of the surface of the image-receiving layer The heat transferable sheet 1 described above is used in combination with a heat transfer sheet.

Figure 4:
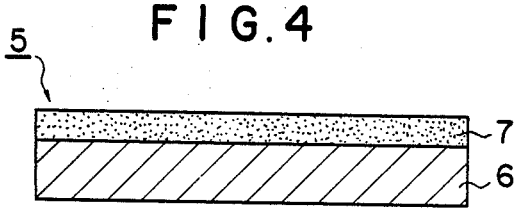
FIG. 4 and FIG. 5 are cross-sectional views of the heat transfer sheet to be used in combination with the heat transferable sheet.

As is illustrated in FIG. 4, a typical heat transfer sheet 5 comprises a support 6 and a heat transfer layer 7 provided on one surface thereof. The heat transfer layer 7 is so formed that a colorant contained therein transfers to the heat transferable sheet upon heating.

Examples of the colorants are disperse dyes having a relatively low molecular weight ranging from about 150 to 400, oil-soluble dyes, certain types of basic dyes, or intermediates that can turn into these dyes. Suitable colorants are selected from among these dyes with due consideration for the heat transfer temperature and efficiency, hue, color rendering, and weatherability.

The colorant is dispersed in a suitable synthetic resin binder which forms a heat transfer layer and applied onto the support 6. Preferably, the synthetic resin binder is selected from resins having high heat resistance and does not hinder the transference of the colorant which occurs upon heating. For example, the following resins are used.

(i) Cellulose resins and Ethyl cellulose, hydroxyethyl cellulose, ethyl hydroxy cellulose, hydroxypropyl cellulose, methyl cellulose, cellulose acetate, and cellulose butyrate (ii) Vinyl resins: Polyvinyl alcohol, polyvinyl acetate, polyvinyl butyral, polyvinyl pyrrolidone, polyester, and polyacrylamide.

Among the synthetic resin binders designated above, polyvinyl butyral resins or cellulose resins are preferred.

The heat transfer layer 7 can be provided on the support 6 by kneading the colorant and the synthetic resin binder together with a solvent or a diluent to prepare a coating composition for the heat transfer layer, and applying this composition onto the support 6 by a suitable printing or coating method. If necessary, additives may be incorporated in the coating composition for the heat transfer layer.

Figure 5:
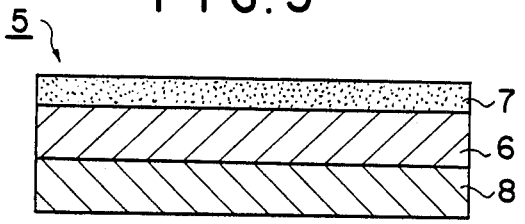

The basic constitution of the heat transfer sheet is as described hereinbefore. In the case where the surface of the support is directly heated by contact heating means such as a thermal head, a lubricative layer 8 containing a lubricant or releasing agent such as a wax is provided on the surface of the support 6 opposite to that on which the heat transfer layer is provided as is shown in FIG. 5, whereby the adhesion between the thermal head and like heating means and the support by fusion can be prevented and the sheet becomes easily slidable.

Figure 6:
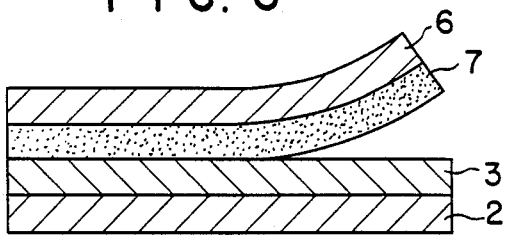
FIG. 6 is a cross-sectional view showing an example of the combination of the heat transferable sheet and the heat transfer sheet.

The heat transfer sheet and heat transferable sheet prepared in the above described manner are mated so that the heat transfer layer of the heat transfer sheet will contact the image-receiving layer of the heat transferable sheet as is illustrated in FIG. 6. By applying to the interface between the heat transfer layer and the image-receiving layer thermal energy corresponding to image information, it is possible to transfer the colorant in the heat transfer layer to the image-receiving layer depending upon the thermal energy.

Hereinafter, the present invention will be specifically described with respect to examples of practice thereof, it being understood that these examples are presented as illustrative only and not intended to limit the scope of the invention. Throughout these examples, quantities expressed in "parts" are "parts by weight".

EXAMPLE 1

An ink composition for forming an image-receiving layer having the following composition was prepared, applied onto a substrate, synthetic paper YUPO FPG #150, in a quantity of 4.0 g/m$^2$ on dry basis, and then dried to obtain a heat transferable sheet.

| | |
|---|---|
| Polyester resin: Vylon 200 (Toyobo K.K., Japan) | 1 part |
| Amino-modified silicone: KF-393 (Shin-etsu Kagaku Kogyo K.K., Japan) | 0.03 part |
| Epoxy-modified silicone: X-22-343 (Shin-etsu Kagaku Kogyo K.K., Japan) | 0.03 part |
| Methyl ethyl ketone/toluene/cyclohexanone (weight ratio: 4:4:2) | 9.0 parts |

Subsequently, an ink composition for forming a heat transfer layer having the following composition was prepared, applied onto a PET film having a thickness of 9 μm with its back surface treated for heat resistance in a quantity of 1.0 g/m$^2$ on dry basis, and dried to obtain a heat transfer sheet.

| | |
|---|---|
| Disperse dye: KST-B-136 (Nihon Kayaku K.K., Japan) | 0.4 part |
| Ethyl hydroxyethyl cellulose (Hercules Inc.) | 0.6 part |
| Methyl ethyl ketone/toluene (weight ratio: 1:1) | 9.0 parts |

The heat transfer layer of the heat transfer sheet thus obtained was brought into contact with the image-receiving layer of the heat transferable sheet obtained in the preceding step, and heating the heat transfer sheet from the back side thereof to carry out printing. When the two sheets were peeled from each other, the image-receiving layer was easily peeled from the transfer layer without causing the resin of the transfer layer to peel off toward the image-receiving layer, and a recorded image having continuous gradation could be obtained.

EXAMPLE 2

An ink composition for forming an image-receiving layer having the following composition was prepared, applied onto a substrate, synthetic paper YUPO FPG #150, in a quantity of 4.0 g/m$^2$ on dry basis, and dried to form an image-receiving layer.

| | |
|---|---|
| Polyester resin: Vylon 200 (Toyobo K.K., Japan) | 1.0 part |
| Methyl ethyl ketone/toluene (weight ratio: 1:1) | 9.0 parts |

Subsequently, a solution for forming a releasing agent layer having the following composition was applied onto the polyester resin layer with Mayer's bar #6, and dried at 100° C. for 5 minutes.

| | |
|---|---|
| Amino-modified silicone: KF-393 | 1.0 part |
| Epoxy-modified silicone: X-22-343 | 1.0 part |
| Ethanol | 25.0 parts |
| Isopropyl alcohol | 23.0 parts |

The solution for forming a releasing agent layer was applied in a quantity of about 0.15 g/m$^2$ on dry basis.

When printing was carried out under the same conditions as in Example 1 on a heat transferable sheet comprising the releasing agent layer thus formed, the heat transfer layer did not adhere to the image-receiving layer by fusion resulting in good releasability.

EXAMPLE 3

A polyester solution having the same composition as that of the ink composition used in Example 2 was applied over the entire surface of a synthetic paper, YUPO FPG #150, of the A5 size (148×210 mm) in a quantity of 4.0 g/m$^2$ on dry basis, and dried to form an image-receiving resin layer.

An ink composition for forming a releasing agent layer having the same composition as that of the solution used in Example 2 was applied by the photo-gravure printing method over half of the surface of the image-receiving layer corresponding to the A6 size, and dried to form a releasing agent layer having a thickness of about 0.1 μm.

Thereafter, sublimation transfer recording was carried out as in the preceding Examples only in the region where the releasing agent layer was formed. Similarly as in the preceding Examples, the transfer layer did not peel off and good releasability was obtained.

Heat transfer printing using a wax was then carried out in the remaining region of the layer consisting of the polyester resin layer by means of a heat transfer printer TN500 (Toshiba, Japan), whereupon printing in distinct black letters could be obtained and revisability was confirmed.

EXAMPLE 4

An ink composition for forming an image-receiving layer having the following composition was prepared, applied onto a substrate, synthetic paper YUPO FPG

#150, in a quantity of about 4.5 g/m² on dry basis, and dried at 100° C. for 10 minutes.

| | |
|---|---|
| Polyester resin: Vylon 103, Tg = 47° C. (Toyobo K.K., Japan) | 0.8 part |
| EVA-based high polymer plasticizer: Elvaloy, Tg = −37° C. (Mitsui Polychemical K.K., Japan) | 0.2 part |
| Amino-modified silicone: KF857 (Shin-etsu Kagaku Kogyo K.K., Japan) | 0.04 part |
| Epoxy-modified silicone: KF103 (Shin-etsu Kagaku Kogyo K.K., Japan) | 0.04 part |
| Methyl ethyl ketone/toluene/cyclohexanone (weight ratio: 4:4:2) | 9.0 parts |

When printing was carried out as in Example 1, good releasability was obtained and the transfer layer did not peel off at all.

EXAMPLE 5

An ink composition for forming an image-receiving layer was prepared, applied onto a substrate, synthetic paper YUPO FPG #150 in a quantity of 4.0 g/m² on dry basis, and then dried.

| | |
|---|---|
| Polyurethane elastomer: Pandex T5670, Tg = −35° C. (Dainippon Ink Chemistry K.K., Japan) | 0.5 part |
| Polyvinyl butyral: Eslec BX-1, Tg = 83° C. (Sekisui Kagaku K.K., Japan) | 0.5 part |
| Methyl ethyl ketone/toluene/ethyl cellosolve (weight ratio: 4:4:2) | 9.0 parts |

Subsequently, a solution for forming a releasing agent layer having the same composition as that of the solution employed in Example 2 was applied under the same conditions on the image-receiving layer obtained in the above step, and dried to form a releasing agent layer.

When printing was carried out similarly as in Example 1 using a thermal head, the transfer layer did not adhere to the image-receiving layer by fusion, resulting in satisfactory releasability.

EXAMPLE 6

A PET film (manufactured by Toyobo, Japan under the name S PET) having a thickness of 9 μm wherein one surface had been subjected to a corona treatment was used as a support. A coating composition for a heat transfer printing layer having the following composition was applied and formed on the corona treated surface of the film by a wire bar coating process to a dry thickness of 1 μm. One or two drops of silicone oil (manufactured by Sin-etsu Silicone, Japan under the name X-41.4003A) was dropped on the reverse side by means of a dropping pipet and thereafter spread over the entire surface to carry out a reverse side treatment coating to prepare a heat transfer printing sheet.

| Coating Composition for Heat Transfer Printing Layer | |
|---|---|
| Disperse dye (manufactured by Nippon Kayaku, Japan under the name Kayaset Blue 136) | 4 parts |
| Ethylhydroxyethyl cellulose | 5 parts |

-continued

| Coating Composition for Heat Transfer Printing Layer | |
|---|---|
| (manufactured by Hercules Inc.) | |
| Toluene | 40 parts |
| Methyl ethyl ketone | 40 parts |
| Dioxane | 10 parts |

A synthetic paper having a thickness of 150 μm (manufactured by Ohji Yuka, Japan under the name YUPO-FPG-150) was used as a substrate. A coating composition for a receptive layer having the following composition was applied to this surface by a wire bar coating process to a dry thickness of 10 μm thereby to prepare a heat transferable sheet. Drying was carried out for one hour in an oven at 100° C. after pre-drying in a dryer. (The solvent was thoroughly driven off.)

| Coating Composition for Receptive Layer | |
|---|---|
| Byron 103 (polyester resin manufactured by Toyobo, Japan; Tg = 47° C.) | 8 parts |
| Elbaroi 741 (EVA polymer plasticizer manufactured by Mitsui Polychemical, Japan; Tg = −32° C.) | 2 parts |
| KF-393 (amino-modified silicone oil manufactured by Sin-etsu Silicone, Japan) | 0.125 part |
| X-22-343 (epoxy-modified silicone oil manufactured by Sin-etsu Silicone, Japan) | 0.125 part |
| Toluene | 70 parts |
| Methyl ethyl ketone | 10 parts |
| Cyclohexanone | 20 parts |

Byron 103 is a second region-forming synthetic resin and Elbaroi 741 is a first region-forming synthetic resin. Because the mutual compatibility of these resins is poor, when they are dissolved in a solvent and the solution is then applied onto a substrate and dried, phase separation occurs to form a first region and a second region.

In the surface of the receptive layer obtained as described above, the periphery of Elbaroi 741 resin which formed the first region was substantially surrounded by Byron 103 resin which formed the second region. The size of the first region formed by surrounding with the second region was in the range of from 5 μm to 100 μm. The proportion of the integrated surface area of the first region portions was 30% of the total.

The heat transfer printing sheet and the heat transferable sheet which were obtained as described above were laminated with the heat transfer printing layer and the receptive layer in mutual contact. Recording was carried out from the support side of the heat transfer printing sheet by means of a thermal head under the conditions of an output of lw/dot, a pulse width of from 0.3 to 4.5 milliseconds and a dot density of 3 dots/mm, of the thermal head. When the optical reflection density of highly developed color density recording portions was measured by means of a Macbeth RD918 reflection densitometer, a value of 2.0 was obtained. The tone obtained at this time had the same transparency as that obtained by causing each dye to undergo monomolecular dispersion and forming colors.

When a thermal diffusion acceleration test was carried out by allowing the recorded sheet described above to stand for 7 days in a 60° C. oven, distortion of the image due to dye diffusion was not observed, and reduction of the density of the recording portions did not occur.

Also, the heat transferable sheet and the heat transfer printing sheet which were obtained as described above were used in combination to examine the relationship between voltage application time to a thermal head and the optical reflection density of the resulting highly developed color density recording portions. The results obtained are shown in curve 1 of FIG.

EXAMPLE 7

A receptive layer-forming coating composition having the following composition was applied and formed on the same substrate described in Example 6 by a wire bar coating process to a dry thickness of 10 μm to form a heat transferable sheet.

| Receptive Layer-forming Coating Composition | |
|---|---|
| Elbaroi 741 (manufactured by Mitsui Polychemical, Japan) | 10 parts |
| KF-393 (manufactured by Sin-etsu Silicone, Japan) | 0.125 part |
| X-22-343 (manufactured by Sin-etsu Silicone, Japan) | 0.125 part |
| Toluene | 50 parts |
| Methyl ethyl ketone | 50 parts |

When the heat transferable sheet obtained as described above and the same heat transfer printing sheet as described in Example 6 were used to carry out recording in the manner described in Example 6, the optical reflection density of the highly developed color density recording portions of the resulting recorded sheet was a value of 2.1 and exhibited a higher value than that of the density obtained in Example 1.

However, when a thermal diffusion acceleration test was carried out by allowing the recorded sheet described above to stand for 7 days in a 60° C. oven, the image was significantly distorted due to dye diffusion, and a reduction of the density of the total recording portions was observed. The optical reflection density of the highly developed color density recording portions was reduced to 1.8.

EXAMPLE 8

A receptive layer-forming coating composition having the following composition was applied and formed on the same substrate described in Example 6 by a wire bar coating process to a dry thickness of 10 μm to form a heat transferable sheet.

| Receptive Layer-forming Coating Composition | |
|---|---|
| Byron 103 (polyester resin manufactured by Toyobo, Japan) | 10 parts |
| KF-393 (manufactured by Sin-etsu Silicone, Japan) | 0.125 part |
| X-22-343 (manufactured by Sin-etsu Silicone, Japan) | 0.125 part |
| Toluene | 50 parts |
| Methyl ethyl ketone | 50 parts |

When the heat transferable sheet obtained as described above and the heat transfer printing sheet of Example 6 were used to carry out recording in the manner described in Example 6, the optical reflection density of the highly developed color density recording portions of the resulting recorded sheet was a value of 1.4.

This value was lower than that of Example 6. Further, the resulting tone was inferior in transparency to that of Example 6, and the developed color was inadequate.

When the recorded sheet described above was allowed to stand for 7 days in a 60° C. oven to carry out a thermal diffusion acceleration test, distortion of the image due to dye diffusion was not observed. However, the developed color density was as high as 1.7, and the tone had changed to the same transparency as that obtained by causing each dye to undergo mono-molecular dispersion and forming color.

EXAMPLE 9

A receptive layer-forming coating composition having the following composition was applied and formed on the same substrate as described in Example 6 by a wire bar coating process to a dry thickness of 10 μm to form a heat transferable sheet.

| Receptive Layer-forming Coating Composition | |
|---|---|
| Byron 103 (manufactured by Toyobo, Japan; Tg = 47° C.) | 7 parts |
| Barsalon 1138 (polyamide resin manufactured by Henkel Nippon, Japan; Tg = −4° C.) | 3 parts |
| KF 393 (manufactured by Sin-etsu Silicone, Japan) | 0.125 part |
| X-22-343 (manufactured by Sin-etsu Silicone, Japan) | 0.125 part |
| Toluene | 57 parts |
| Xylene | 13 parts |
| Methyl ethyl ketone | 6.3 parts |
| 2-Butanol | 14 parts |
| Cyclchexanone | 30 parts |

Byron 103 is a second region-forming synthetic resin and Barsalon 1138 is a first region-forming synthetic resin. Because the mutual compatibility of these resins is poor, when they are dissolved in a solvent and the solution is then applied onto a substrate and dried, phase separation occurs to form a first region and a second region.

In the surface of the receptive layer obtained as described above, the periphery of Barsalon 1138 resin which formed the first region was substantially surrounded by Byron 103 resin which formed the second region. The size of the first region formed by surrounding with the second region was in the range of from 1 μm to 100 μm. The proportion of the integrated surface area of the first region portions was 30% of the total. When the heat transferable sheet obtained as described above and the same heat transfer printing sheet as described in Example 6 were used to carry out recording in the manner described in Example 6, the optical reflection density of the highly developed color density recording portions of the resulting recorded sheet exhibited a value of 1.79.

When a thermal diffusion acceleration test was carried out by allowing the recorded sheet described above to stand for 7 days in a 60° C. oven, distortion of the image due to dye diffusion was not observed, and reduction of the density of the recording portions did not occur.

EXAMPLE 10

A receptive layer-forming coating composition having the following composition was applied and formed on the same substrate as described in Example 6 by a wire bar coating process to a dry thickness of 10 μm to form a heat transferable sheet.

| Receptive Layer-forming Coating Composition | |
|---|---|
| Pandex T5670 (polyurethane elastomer manufactured by Dai Nippon Ink Kagaku, Japan; Tg = −35° C.) | 3 parts |
| Eslex BX-1 (polyvinyl butyral resin manufactured bv Sekisui Kagaku, Japan; Tg = +83° C.) | 7 parts |
| KF-393 (manufactured by Sin-etsu Silicone, Japan) | 0.125 part |
| X-22-343 (manufactured by Sin-etsu Silicone, Japan) | 0.125 part |
| Toluene | 70 parts |
| Methyl ethyl ketone | 70 parts |
| Methyl isobutyl ketone | 12 parts |
| Ethyl cellosolve | 5 parts |

Pandex T5670 is a first region-forming synthetic resin and Eslex BX-1 is a second region-forming synthetic resin. Because the mutual compatibility of these resins is poor, when they are dissolved in a solvent and the solution is then applied onto a substrate and dried, phase separation occurs to form a first region and a second region.

In the surface of the receptive layer obtained as described above, the periphery Pandex T5670 resin which formed the first region was substantially surrounded by Eslex BX-1 resin which formed the second region. The size of the first region formed by surrounding with the second region was in a range of no more than 20 μm. The proportion of the integrated surface area of the first region portions was 15% of the total.

When the heat transferable sheet obtained as described above and the same heat transfer printing sheet as described in Example 6 were used to carry out recording in the manner described in Example 6, the optical reflection density of the highly developed color density recording portions of the resulting recorded sheet exhibited a value of 1.3.

When the recorded sheet described above was allowed to stand for 7 days in a 60° C. oven to carry out a thermal diffusion acceleration test, distortion of the image due to dye diffusion was not observed, and reduction of the density of the recording portions did not occur.

EXAMPLE 11

A receptive layer-forming coating composition having the following composition was applied and formed on the same substrate as described in Example 6 by a wire bar coating process to a dry thickness of 10 μm to form a heat transferable sheet.

| Receptive Layer-forming Coating Composition | |
|---|---|
| Byron 630 (polyester resin manufactured by Toyobo, Japan; Tg = 7° C.) | 2 parts |
| Eslex BX-1 (polyvinyl butyral resin manufactured by Sekisui Kagaku, Japan; Tg = 83° C.) | 4 parts |
| KF-393 (manufactured by Sin-etu Silicone, Japan) | 0.075 part |
| X-22-343 (manufactured by Sin-etsu Silicone, Japan) | 0.075 part |
| Toluene | 46 parts |
| Methyl ethyl ketone | 42 parts |
| Cyclohexanone | 4 parts |

Byron 630 is a first region-forming synthetic resin and Eslex BX-1 is a second region-forming synthetic resin. Because the mutual compatibility of these resins is poor, when they are dissolved in a solvent and the solution is applied onto a substrate and dried, phase separation occurs to form a first region and a second region.

In the surface of the receptive layer obtained as described above, the periphery of Byron 630 resin which formed the first region was substantially surrounded by Eslex BX-1 resin which formed the second region. The size of the first region formed by surrounding with the second region was in a range of from 1 μm to 100 μm. The proportion of the integrated surface area of the first region portions was 30% of the total.

When the heat transferable sheet obtained as described above and the same heat transfer printing sheet as described in Example 6 were used to carry out recording in the manner described in Example 6, the optical reflection density of the highly developed color density recording portions of the resulting recorded sheet was found to be a value of 1.2.

When the recorded sheet described above was allowed to stand for 7 days in a 60° C. oven to carry out a thermal diffusion acceleration test, distortion of the image due to dye diffusion was not observed, and reduction of the density of the recording portions did not occur.

EXAMPLE 12

A receptive layer-forming coating composition having the following composition was applied and formed on the same substrate as described in Example.6 by a wire bar coating process to a dry thickness of 15 μm to form a heat transferable sheet.

| Receptive Layer-forming Coating Composition | |
|---|---|
| Byron 103 (polyester manufactured by Toyobo, Japan; Tg = 47° C.) | 8 parts |
| Elbaroi 741 (manufactured by Mitsui Polychemical, Japan; Tg = −32° C.) | 2 parts |
| KF-393 (manufactured by Sin-etsu Silicone, Japan) | 0.125 part |
| X-22-343 (manufactured by Sin-etsu Silicone, Japan) | 0.125 part |
| Cinubin 328 (ultraviolet absorber manufactured by Ciba-Geigy Corporation) | 0.5 part |
| Toluene | 70 parts |
| Methyl ethyl ketone | 10 parts |
| Cyclohexanone | 20 parts |

Byron 103 is a second region-forming synthetic resin and Elbaroi 741 is a first region-forming synthetic resin. Because the mutual compatibility of these resin is poor, when they are dissolved in a solvent, and the solution is applied onto a substrate and dried, phase separation occurs to form a first region and a second region.

The heat transferable sheet obtained as described above and the same heat transfer printing sheet as described in Example 6 were used to carry out recording in the manner described in Example 6. The hue and the optical density of the recording portions obtained were the same as those obtained in Example 6.

Furthermore, when a thermal diffusion acceleration test was carried out by allowing the recorded sheet to stand for 7 days in a 60° C. oven, the same results as described in Example 6 were obtained.

The recorded sheet described above was irradiated with light by means of a due cycle superlong life sunshine weather-meter (manufactured by Suga Shikenki, Japan) to carry out a light-resistance test. When the recorded sheet obtained by Example 6 was irradiated with light for 2 hours, it discolored to a reddish hue. Even when the recorded sheet according to this Example 12 was irradiated with light for 2 hours, no discoloration was observed because the ultraviolet absorber was incorporated in the receptive layer.

EXAMPLE 13

The following components were dispersed in water and continuously stirred for 60 minutes at a temperature of 50° C. They were subjected to ultrasonic dispersion for 5 minutes to prepare a receptive layer-forming coating composition.

| Receptive Layer-forming Coating Composition | |
|---|---|
| Gosenol T330 (polyvinyl alcohol manufactured by Nippon Gosei, Japan; Tg = 68° C.) | 4 parts |
| Polysol EVA AD-5 (ethylene-vinyl acetate emulsion manufactured by Showa Kohbunshi, Japan; Tg = 0° C.) | 10 parts |
| Water | 76 parts |

Gosenol T330 is a second region-forming synthetic resin and Polysol EVA AD-5 is a first region-forming synthetic resin.

The receptive layer-forming coating composition was applied and formed on the same substrate as described in Example 6 by a wire bar coating process to a dry thickness of 10 μm to form a heat transferable sheet.

In the surface of the receptive layer obtained as described above, the periphery of ethylene-vinyl acetate resin which formed the first region was substantially surrounded by the polyvinyl alcohol resin which formed the second resin. The size of the second region formed by surrounding by the first region was in a range of no more than 5 μm. The proportion of the integrated surface area of the first region was 50% of the total.

When the heat transferable sheet obtained as described above and the same heat transfer printing sheet as described in Example 6 were used to carry out recording in the manner described in Example 6, the transfer printing layer of the heat transfer printing sheet was transferred to the surface of the resulting recorded sheet. When the transferred portions were removed by means of an adhesive tape, and thereafter the optical reflection density of the highly developed color density recording portions of the resulting recorded sheet was measured, a value of 1.0 was obtained.

When a thermal diffusion acceleration test was carried out by allowing the recorded sheet described above to stand for 7 days in a 60° C. oven, distortion of the image due to dye diffusion was not observed, and reduction of the density of the recording portions did not occur.

EXAMPLE 14

Synthetic paper (manufactured by Ohji Yuka, Japan under the name YUPO FPG-150) having a thickness of 150 μm was used as a substrate. A receptive layer-forming coating composition having the following composition was applied and formed thereon by a wire bar coating process to a dry thickness of 5 μm.

-continued

| Receptive Layer-forming Coating Composition | |
|---|---|
| Elbaroi 742 (manufactured by Mitsui Polychemical, Japan) | 10 parts |
| KF-393 (amino-modified silicone oil manufactured by Sin-etsu Silicone, Japan; Tg = −32° C.) | 0.125 part |
| X-22-343 (epoxy-modified silicone oil manufactured by Sin-etsu Silicone, Japan) | 0.125 part |
| Toluene | 50 parts |
| Methyl ethyl ketone | 50 parts |

On the other hand, a mask for patterning the receptive layer formed as described above was prepared as follows.

First, a sheet of iron having a thickness of 0.1 mm was washed. A photosensitive resin (manufactured by Tokyo Ohka, Japan under the name FPR) was then applied onto the sheet by a spin coating process to a dry thickness of 5 μm. An original having a line width of 20 μm and a pitch of 200 μm was then superposed thereon and exposed to light in a printer provided with an ultra-high pressure mercury lamp (manufactured by Dojun Kohki, Japan) for one minute. Developing was carried out in a specific manner. The surface opposite to the patterning image was covered with a resin and thereafter etched with an iron chloride solution to obtain an iron mask having a reed screen-like pattern of a line width of 20 μm and a pitch of 200 μm.

This mask was then superposed on the receptive layer described above, and the masked layer was irradiated with electron rays under an accelerating voltage of 175 kV in a dose of 30 megarads by electron ray irradiation means to cure the receptive layer in the form of the pattern. Further, the mask described above was rotated through an angle of 90° on the receptive layer and thereafter similarly irradiated with electron rays in a dose of 30 megarads to partially crosslink the receptive layer in the form of lattice to obtain a heat transferable sheet. The portions partially crosslinked in the form of lattice correspond to the second region.

When the heat transferable sheet obtained as described above and the same heat transfer printing sheet as described in Example 6 were used to carry out recording in the manner described in Example 6, the optical reflection density of the highly developed color density recording portions of the resulting recorded sheet was found to be of a value of 1.8.

When the recorded sheet described above was allowed to stand for 7 days in a 60° C. oven to carry out a thermal diffusion acceleration test, distortion of the image due to dye diffusion was not observed, and reduction of the density of the recording portions did not occur.

EXAMPLE 15

Figure 7:
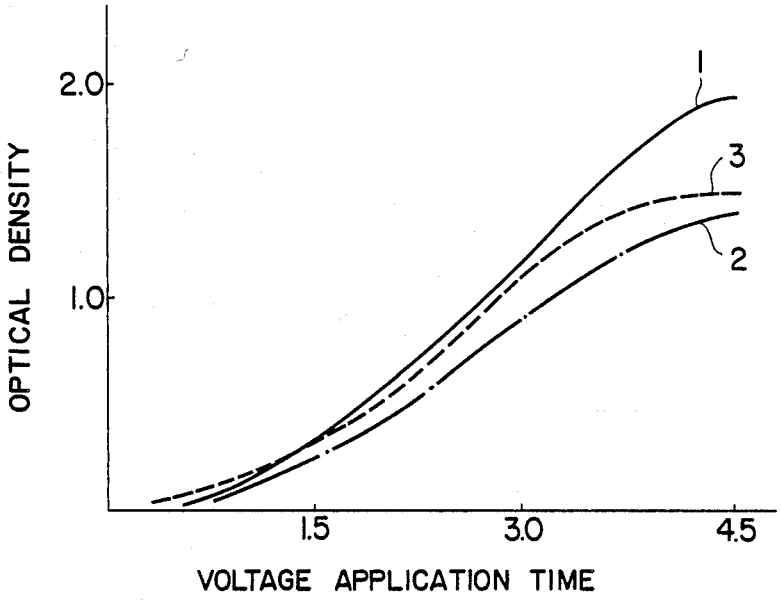
Fig. 7 is a graph indicating relationships between time during which voltage is applied to a thermal head in heating the combination of a heat transfer printing sheet and a heat transferable sheet according to the present invention and the optical reflection density of the resulting highly developed color density recording portions.

A heat transfer printing sheet and a heat transferable sheet were obtained in the manner described in Example 6 except that 2.5 parts of Kayaset Red B manufactured by Nippon Kayaku (Japan) which was a Magenta dye was used in place of Kayaset Blue 136 manufactured by Nippon Kayaku (Japan), as a dye. These sheets were combined in the same manner as described in Example 6, and the relationship between time of application of voltage to the thermal head and the optical reflection density of the resulting highly developed color density recording portions was examined. The results obtained are indicated by curve 2 in FIG. 7.

EXAMPLE 16

A heat transfer printing sheet and a heat transferable sheet were obtained in the manner described in Example 6 except that 0.6 parts of PTY-52 manufactured by Mitsubishi Kasei (Japan) which was a yellow dye was used in place of Kayaset Blue 136 manufactured by Nippon Kayaku (Japan), as a dye. Dhese sheets were combined in the same manner as described in Example 6, and the relationship between time of application of voltage to the thermal head and the optical reflection density of the resulting highly developed color density recording portions was examined. The results obtained are indicated by curve 3 in FIG. 7.

EXAMPLE 17

Printing was carried out in the manner described in Example 6 except that a condenser paper having a thickness of 10 μm was used in place of the PET film having a thickness of 9 μm as a support of a heat transfer printing sheet in Example 6, and the reverse side treatment with silicone oil was omitted. The optical reflection density of the highly developed color density recording portions of the recorded sheet exhibited a value of 1.40.

EXAMPLE 18

Printing was carried out in the manner described in Example 17 except that 2.5 parts of Kayaset Red B manufactured by Nippon Kayaku (Japan) was incorporated in place of Kayaset Blue 136 manufactured by Nippon Kayaku (Japan), as a dye in Example 17. The optical reflection density of the highly developed color density recording portions of the recorded sheet was 1.38.

EXAMPLE 19

Printing was carried out in the manner described in Example 18 except that 0.6 part of PTY-52 manufactured by Mitsubishi Kasei (Japan) was incorporated in place of Kayaset Blue 136 manufactured by Nippon Kayaku (Japan), as a dye in Example 17. The optical reflection density of the highly developed color density recording portions of the recorded sheet was 1.38.

EXAMPLE 20

Printing was carried out in the manner described in Example 6 except that synthetic paper the surface of which was covered with calcium carbonate powder (manufactured by Ohji Yuka, Japan under the name YUPO-FPG-150) was used as a heat transferable sheet. The optical reflection density of the highly developed color density recording portions of the recorded sheet was of a value as low as 0.44.

EXAMPLE 21

A primer layer-forming coating composition having the following composition was applied onto a polyethylene terephthalate film having a thickness of 100 μm (manufactured by Toray, Japan, under the name T-PET) by means of a rotary coater to a dry thickness of the layer of 1 μm. Drying was carried out by placing the PET film coated with the coating described above in a 90° C. oven for one minute.

| Receptive Layer-forming Coating Composition | |
|---|---|
| AD502 (polyester polyol manufactured by Tokyo Motor, Japan) | 0.95 part |
| Collonate L (isocyanate manufactured by Nippon Polyurethane, K.K., Japan) | 0.05 part |
| Toluene | 6 parts |
| Methyl ethyl ketone | 6 parts |
| Ethyl acetate | 7 parts |

A negative-type photoresist (manufactured by Asahi Kasei, K.K., Japan under the name APR G-22) was then applied onto the surface of polyethylene terephthalate described above wherein the surface was provided with the primer layer by means of a rotary coater to a dry thickness of 50 μm. The primer layer was then dried in a 100° C. oven for 10 minutes.

The surface of the above negative-type resist layer was brought into contact with the surface of a silver salt permeable original film wherein it had a dot pattern comprising tetragonal patterns of sides of 170 μm each disposed at intervals of 30 μm. The laminated structure was exposed to light for 10 seconds, by means of an ultraviolet printer wherein a point source of high-pressure mercury lamp was used, and developed with a 0.2% sodium bicarbonate aqueous solution warmed to a temperature of 50° C. The uncured portions of the resist described above were dissolved and removed and washed to form a lattice-like pattern of a line width of 30 μm and an interval of 170 μm onto the film. This lattice-like pattern formed a second region. (Tg of this region is 80° C.).

A receptive layer-forming composition (I) having the following composition was then applied by means of a rotary coater and dried by means of a dryer. This step was repeated three times to form a first region at the portions surrounded by the lattice-like pattern on the film.

| Receptive Layer-forming Composition (I) | |
|---|---|
| Elbaroi 741 (EVA polymer plasticizer manufactured by Mitsui Polychemical, Japan) | 10 parts |
| Toluene | 45 parts |
| Methyl ethyl ketone | 45 parts |

Further, a receptive layer-forming coating composition (II) described hereinafter was applied and formed by means of a rotary coater so that the portions of the film surrounded by the lattice-like pattern were thoroughly embedded on drying to form a heat transferable sheet. Drying was carried out for one hour at a temperature of 100° C. after temporarily drying by means of a dryer.

| Receptive Layer-forming Composition (II) | |
|---|---|
| Elbaroi 741 (EVA polymer plasticizer manufactured by Mitsui Polychemical, K.K., Japan) | 10 parts |
| KF-393 (amino-modified silicone oil manufactured by Sin-etsu Silicone, K.K., Japan) | 0.125 part |
| X-22-343 (epoxy-modified silicone oil manufactured by Sin-etsu Silicone, K.K., Japan) | 0.125 part |
| Toluene | 45 parts |
| Methyl ethyl ketone | 45 parts |

In the surface of the receptive layer obtained as described above, the periphery of Elbaroi 741 which formed the first region was substantially surrounded by the negative-type photoresist which formed the second region. The side of the first region formed by surrounding by the photoresist was in a range of from 100 μm to 200 μm. The proportion of the integrated surface area of the first region was 70% of the total.

When the heat transferable sheet obtained as described above and the same heat transfer printing sheet as described in Example 6 were used to carry out recording in the manner described in Example 6, the optical reflection density of the highly developed color density recording portions of the resulting recorded sheet was 1.9.

When the recorded sheet described above was allowed to stand for 7 days in a 60° C. oven to carry out a thermal diffusion acceleration test, distortion of the image due to dye diffusion was not observed, and reduction of density of the recording portions did not occur.

EXAMPLE 22

Each component described hereinafter was amply kneaded by means of three rolls to form a receptive layer-forming coating composition having a viscosity of 2,500 ps.

| Receptive Layer-forming Coating Composition | |
|---|---|
| Polyethylene glycol (molecular weight = 2,000) | 5 parts |
| Terpene phenol resin (manufactured by Yasuhara Yushi Kogyo, Japan under the name YS Polystar S-145) | 12 parts |
| Dioctyl phthalate | 2 parts |
| Triethyleneglycol-mono-n-butyl ether | 6 parts |
| Kaolin (manufactured by Tuchiya Kaolin, Japan under the name Kaolin ASP-170) | 14 parts |

A reproduction/press plate was formed on a waterless lithographic plate with a surface having a layer of silicone resin, by using a photographic original wherein a square pattern of sides each of 150 μm (black portion) was regularly disposed at intervals of 30 μm in both longitudinal and lateral directions. A mirror coated paper was printed with the receptive layer-forming coating composition described above to obtain a heat transferable sheet which comprised repeated island-like patterns 150 μm square.

When the thus obtained heat transferable sheet and the same heat transfer printing sheet as described in Example 6 were used to carry out printing in the manner described in Example 6, a developed color image having a maximum density of 1.4 was obtained. While this recorded sheet was heated for 7 days at a temperature of 50° C., the image did not fade because the developed color portions were thoroughly separated from on another.

The waterless lithographic printing plate used in the foregoing procedure was prepared as follows.

(1) Preparation of Silicone Resin 266 parts of acryloxypropyl trichlorosilane was dropwise added to a mixture of 500 parts of water, 100 parts of toluene and 50 parts of isopropanol over one hour at a temperature of from 5° to 10° C. The hydrochloric acid layer was then separated and the siloxane-toluene layer was washed with water until the pH was 6.8. To this siloxane-toluene layer were then added 612 parts of α,ω-dihydroxydimethyl organopolysiloxane having the formula

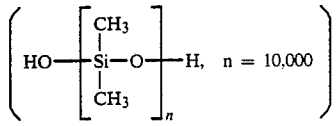

0.5 parts of potassium acetate, and 0.5 parts of hydroquinone.

The reaction was carried out for 8 hours at a temperature of from 110° to 115° C., and then the toluene was vacuum distilled. A pale yellow transparent solid organopolysiloxane having a pour point of 45° C. was obtained, and the yield thereof was 754 parts.

(2) Preparation of Sensitizer

A Grignard reagent was prepared in tetrahydrofuran from 0.2 mole of 4-trimethylsilylchloro-benzene and 0.2 mole of magnesium and reacted with 0.2 mole of 4-dimethylaminobenzaldehyde. Thereafter, 0.2 mole of benzaldehyde were added thereto to carry out an Oppenauer oxidation reaction, thereby synthesizing 4-dimethylamino-4'-trimethylsilylbenzophenone.

(3) Preparation of Lithographic Plate

| | |
|---|---|
| Photopolymerizable organopolysiloxane obtained in the step (1) | 100 parts |
| 4-Dimethylamino-4'-trimethylsilylbenzophenone obtained in the step (2) | 5 parts |
| Toluene | 1,000 parts |

The polymerizable formulation having the composition described above was rotationally applied onto an aluminum plate to obtain a film thickness of about 5 μm and dried to form a waterless lithographic plate.

(4) Preparation of Press Plate for Lithography

A photograph original was brought into contact with the non-aluminum surface of the waterless lithographic plate obtained in the step (3) under reduced pressure. The original and the plate were irradiated with light from a 3 kW high-pressure mercury lamp spaced 40 cm therefrom for 30 seconds, and thereafter developing was carried out with xylene. The plate was then wetted to obtain a press plate for lithography wherein water was unnecessary.

(5) Printing

The press plate obtained in the step (4) was used in an offset one-color press (KOR-type press manufactured by Heiderberger Druckmaschinen Aktiengesellschaft) to carry out printing. In printing a water rod was removed.

We claim:

1. An image-receiving sheet for use in an image-forming system wherein said sheet is brought into contact with a heat transfer sheet, said heat transfer sheet having a support and a heat transfer layer provided on the support comprising a heat transferable dye contained in a synthetic resin binder, wherein an image is formed on the image-receiving sheet by contacting the heat transfer layer with the image-receiving sheet and selectively heating at least a portion of the heat transfer sheet with heating means to transfer the dye selectively from the heat transfer layer to the image-receiving sheet, the image-receiving sheet comprising:

a substrate; and an image-receiving layer provided on the substrate for receiving dye transferred from the heat transfer layer of the heat transfer sheet, said image-receiving layer comprising a synthetic resin for receiving the dye and a releasing agent for preventing adhesion of the synthetic resin binder of the heat transfer sheet to said image-receiving sheet upon heating thereof by the heating means, at least a portion of the surface of the synthetic resin being covered by the releasing agent.

2. An image-receiving sheet as claimed in claim 1, wherein said heating means comprises a dot-type heating device.

3. An image-receiving sheet as claimed in claim 1, wherein said heating means comprises a thermal head.

4. An image-receiving sheet as claimed in claim 1, wherein said substrate is selected from the group consisting of synthetic papers, flexible thin sheets of paper and flexible thin sheets of plastic film.

5. An image-receiving sheet as claimed in claim 1, wherein said releasing agent is selected fom the group consisting of solid waxes, fluorine- or phosphate-containing surfactants and silicon oils.

6. An image-receiving sheet as claimed in claim 1, wherein said releasing agent is selected from the group consisting of silicone oils and hardened-type silicone oils.

7. An image-receiving sheet as claimed in claim 1, wherein said synthetic resin of the image-receiving layer is selected from the group consisting of resins having at least one ester linkage, resins having at least one urethane linkage, resins having at least one amide linkage, resins having at least one urea linkage and resins having at least one highly polar linkage.

8. An image-receiving sheet as claimed in claim 1, wherein said synthetic resin of the image-receiving layer is selected from the group consisting of synthetic resins having a glass transition temperature of from −100° to 20° C. while having a polar radical, synthetic resins having a glass transition temperature of at least about 40° C. and mixtures thereof.

9. The image-receiving sheet of claim 1, wherein said dye is transferable to said image-receiving sheet by heating by said heating means for a few milliseconds.

10. An image-receiving sheet as claimed in claim 1, wherein the image-receiving layer comprises first and second layers, the first layer being closer to said substrate than the second layer, the concentration of said synthetic resin being greater in said first layer than in said second layer.

11. An image-receiving sheet for use in an image-forming system wherein said sheet is brought into contact with a heat transfer sheet, said heat transfer sheet having a support and a heat transfer layer provided on the support comprising a heat transferable dye contained in a synthetic resin binder, wherein an image is formed on the image-receiving sheet by contacting the heat transfer layer with the image-receiving sheet and selectively heating at least a portion of the heat transfer sheet with heating means to transfer the dye selectively from the heat transfer layer to the image-receiving sheet, the image-receiving sheet comprising:

a substrate; and an image-receiving layer provided on the substrate for receiving dye transferred from the heat transfer layer of the heat transfer sheet, said image-receiving layer comprising a synthetic resin for receiving the dye and a releasing agent for preventing adhesion of the synthetic resin binder of the heat transfer sheet to said image-receiving sheet upon heating thereof by the heating means, said image-receiving layer comprising two layers, a first layer provided on said substrate and comprising the synthetic resin and a second layer provided on the first layer and comprising the releasing agent.

12. An image-receiving sheet as claimed in claim 11, wherein said second layer is provided only on a part of the first layer.

* * * * *